US007172457B1

(12) United States Patent
Lin

(10) Patent No.: US 7,172,457 B1
(45) Date of Patent: Feb. 6, 2007

(54) LOCKING DEVICE

(75) Inventor: Chin-Chi Lin, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/408,036

(22) Filed: Apr. 21, 2006

(51) Int. Cl.
*H01R 13/66* (2006.01)

(52) U.S. Cl. ..... 439/565

(58) Field of Classification Search ..... 439/560, 439/562, 565, 571
See application file for complete search history.

(56) References Cited

U.S. PATENT DOCUMENTS 4,681,389 A * 7/1987 Nakazawa et al. ..... 439/557
5,104,339 A * 4/1992 Verhoeven ..... 439/567
5,171,165 A * 12/1992 Hwang ..... 439/567
5,334,049 A * 8/1994 Kachlic et al. ..... 439/567
6,638,105 B1 * 10/2003 Wu ..... 439/567

* cited by examiner

*Primary Examiner*—Briggitte R. Hammond
(74) *Attorney, Agent, or Firm*—Rosenberg, Klein & Lee

(57) ABSTRACT

A locking device, adapted to mount an electrical connecotor to an electronic component, comprises a body, connecting portions respectively extending from both sides of the body, and resilient arms for engaging with the electronic component downwardly extending from ends of the connecting portions. A space for accommodating elastic deformation of the resilient arms is formed among the body and the connecting portions. Alternatively, the locking device comprises a body, connecting portions respectively extending from both sides of the body, and resilient arms for engaging with the electronic component downwardly extending from ends of the connecting portions. Additionally, the locking device is provided with points of initial deformation and points of engagement, and the points of initial deformation are located outside of the points of engagement.

11 Claims, 5 Drawing Sheets

LOCKING DEVICE

BACKGROUND OF THE INVENTION

1. Field of the Invention

The present invention relates to a locking device and, particularly, to a locking device adapted to mount an electrical connecotor on a circuit board.

2. Description of the Related Art

Referring to FIGS. 1 to 3, a conventional locking device 10*a* is installed in an electrical connecotor (not shown) and allows the connector to be mounted on a circuit board 20*a*. The locking device 10*a* comprises a body 11*a*, a pair of resilient arms 13*a*, and a pair of connecting portions 12*a* extending from the body 11*a*. The connecting portions 12*a* and a material band (not shown) connected thereto are connected outside of the resilient arms 13*a*. The resilient arms 13*a* each comprisesd of an extending portion 14*a* and an outwardly protruding engaging portion 15*a*. Referring to FIGS. 2 and 3, during the assembly process, the operator aligns a through hole 21*a* of a circuit board 20*a* with the pair of extending portions 14*a*, and presses the electrical connecotor to push the pair of engaging portions 15*a* to move downwardly. Thus the engaging portions are inserted into a through hole 21*a* and locked on the bottom of the circuit board, thereby mounting the electrical connecotor (not shown) on the circuit board. However, when the extending portions 14*a* are inserted into the through hole 21*a* of the circuit board 20*a*, the resilient arms 13*a* deform elastically and contact the body 11*a* directly. Furthermore, there is no space for accommodating the elastic deformation of the resilient arms 13*a*. Under these circumstances, the resilient arms will probably deform permanently and lose elasticity due to excessive force being applied thereto. Once deformed, they cannot firmly mount the electrical connecotor on the circuit board any more.

Therefore, in view of the above drawbacks of the prior locking device, the inventor proposes the present invention to overcome the above problems based on his deliberate researches and related principles.

SUMMARY OF THE INVENTION

The object of the present invention is to provide a locking device that can be firmly mounted on an electronic component.

According to one aspect of the present invention, the locking device, adapted to mount an electrical connecotor to a circuit board, comprises a body, connecting portions respectively extending from both sides of the body, and resilient arms for engaging with the electronic component downwardly extending from ends of the connecting portions. A space for accommodating elastic deformation of the resilient arms is formed among the body and the connecting portions.

According to another aspect of the present invention, the locking device comprises a body, connecting portions respectively extending from both sides of the body, and resilient arms for engaging with the electronic component downwardly extending from ends of the connecting portions. Additionally, the locking device is provided with points of initial deformation and points of engagement, and the points of initial deformation are located outside of the points of engagement.

Compared with the prior art, the present invention has the following merits. First, permanent deformation of the resilient arms caused by excessive forces can be avoided since a space for accommodating the elastic deformation of the resilient arms is formed between the body and the connecting portions, and therefore a better elasticity of the resilient arms can be obtained and the locking device can firmly mount the electrical connecotor on the electronic component. Second, since the points of initial deformation are located outside of the points of engagement, the locking device can firmly be mounted on the electronic component.

For further understanding of the invention, reference is made to the following detailed description illustrating the embodiments and examples of the invention. The description is only for illustrating the invention and is not intended to be considered limiting of the scope of the claim.

BRIEF DESCRIPTION OF THE DRAWINGS

The characteristics and the technical contents of the present invention will be further understood in view of the detailed description and accompanying drawings. However, it should be noted that the drawings are illustrative but not used to limit the scope of the present invention. Wherein.

DETAILED DESCRIPTION OF THE PREFERRED EMBODIMENTS

Figure 1:
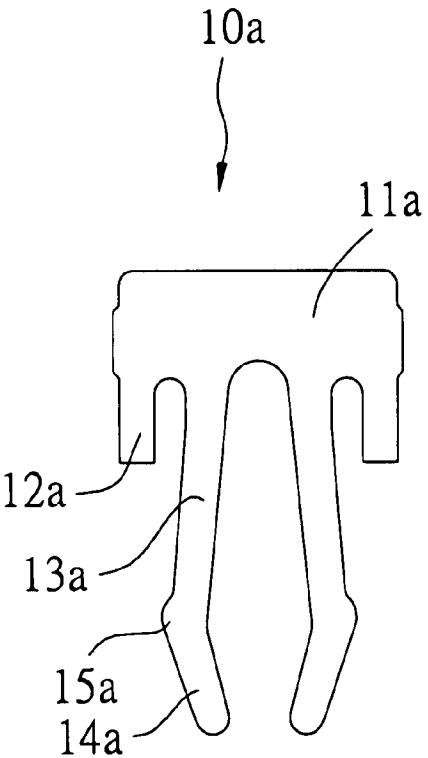
FIG 1 PRIOR ART
FIG. 1 is a front view showing a conventional locking device in prior art.
Figure 2:
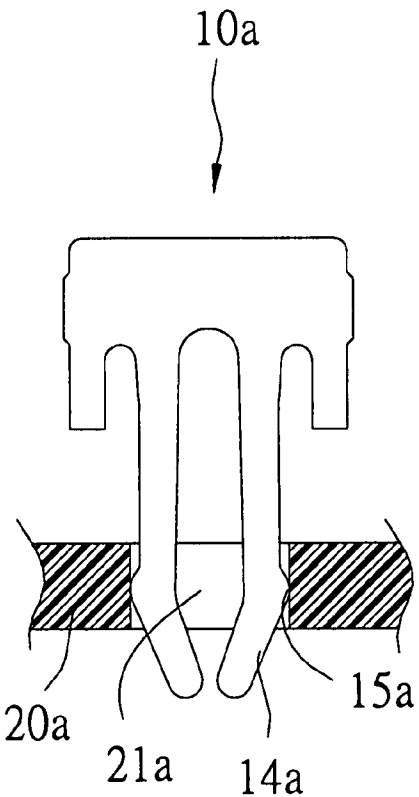
FIG 2 PRIOR ART
FIG. 2 is a front view showing the locking device shown in FIG. 1 being inserted into a circuit board.
Figure 3:
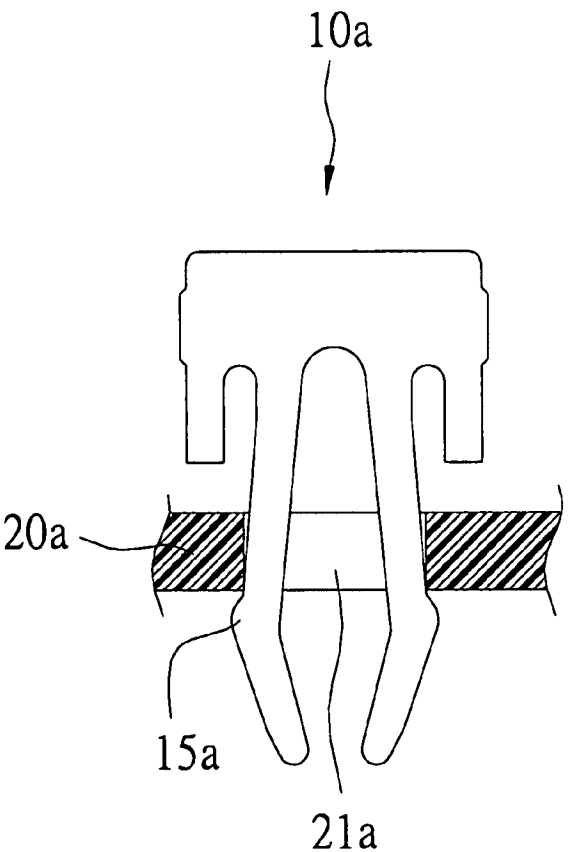
FIG 3 PRIOR ART
FIG. 3 is another front view showing the locking device shown in FIG. 1 mounted on a circuit board.
Figure 4:
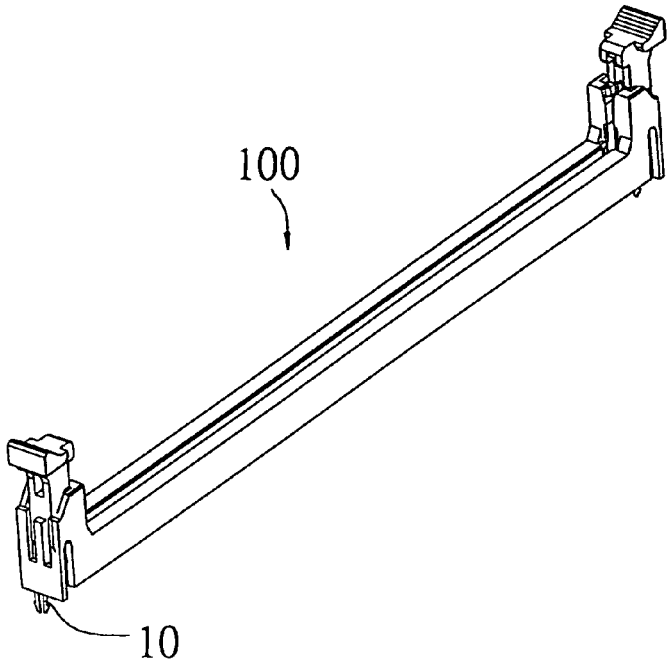
FIG. 4 is a view showing a locking device mounted on an electrical connector according to the present invention.
Figure 5:
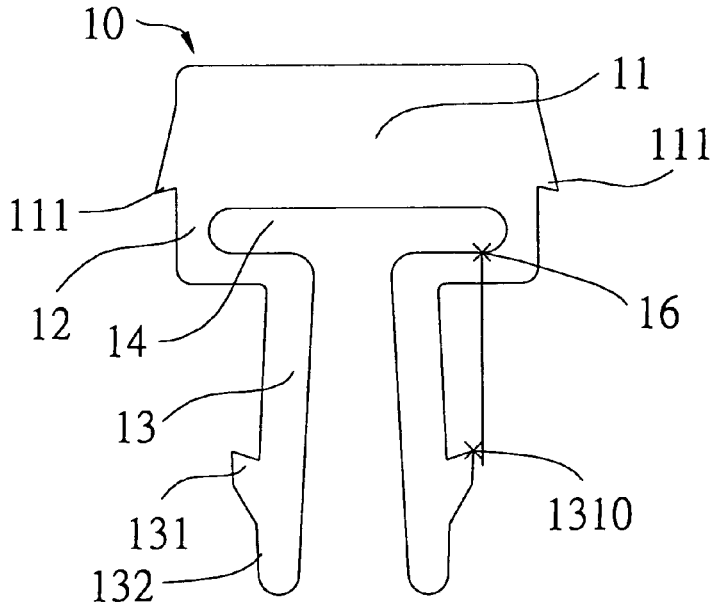
FIG. 5 is a front view showing a locking device according to the present invention.

Referring to FIGS. 4 to 7, according to the present invention, a locking device 10 is inserted into a through hole (not shown) beneath an electrical connecotor 100, thereby mounting the electrical connecotor 100 on an electronic component. In this embodiment, the electronic component is substantially a circuit board, and it can be any other components which can be connected with the electrical connecotor.

The locking device 10 comprises a body 11, a pair of connecting portions 12 respectively extending from both sides of the body, and a pair of resilient arms 13 for engaging with a circuit board 200 each downwardly extending from one end of the connecting portion. A point of initial deformation 16 is provided at the interconnection of the resilient arm 13 and the connecting portion 12. A space 14 encloses the body 11 and the pair of connecting portions 12. The pair of resilient arms 13 are spaced apart. Each resilient arm 13 has a protruding barb 131 for engaging with the circuit board 200, and each barb 131 is provided with a point of engagement 1310. When the locking device is placed vertically, the points of engagement 1310 are located inside of the points of initial deformation 16. Meanwhile, one end of the resilient arm 13 is provided with guiding portion 132 for guiding the barb 131 to quickly engage with the circuit board 200. Each side of the body 11 is provided with an engaging portion 111 for engaging with the electrical connector 100.

Figure 6:
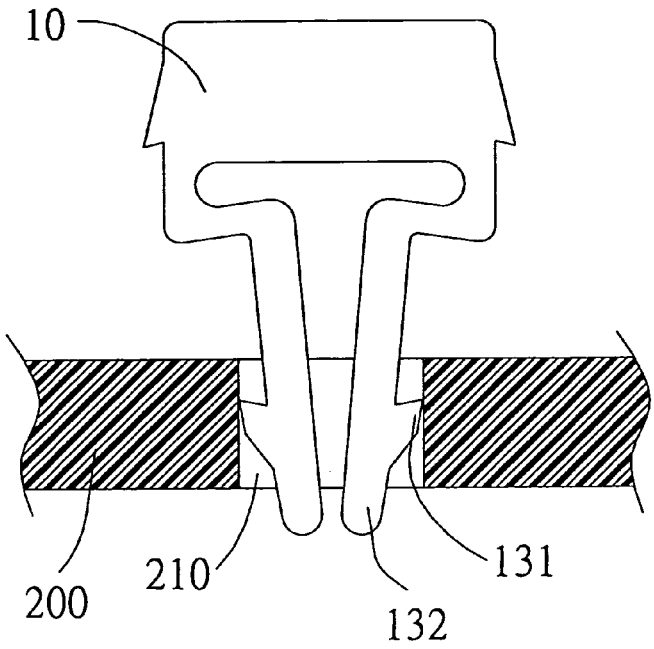
FIG. 6 is a front view showing the locking device shown in FIG. 5 being inserted into a circuit board.
Figure 7:
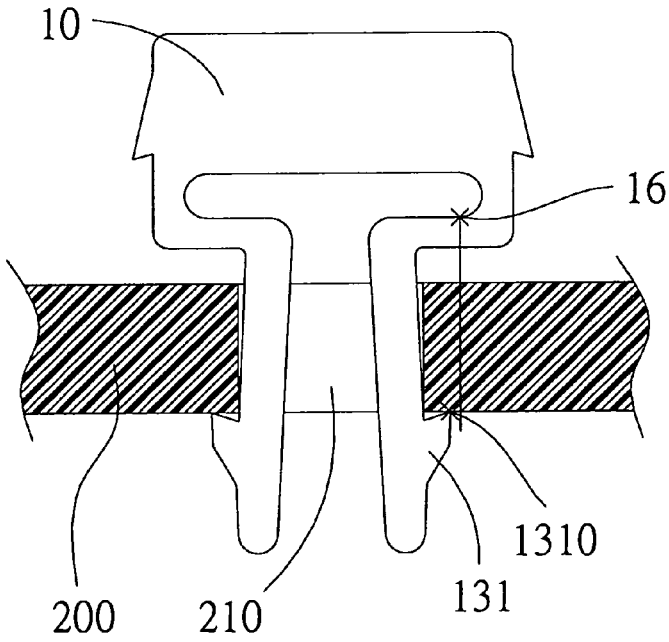
FIG. 7 is another front view showing the locking device shown in FIG. 5 mounted on a circuit board.

Referring to FIGS. 6 and 7, during the assembly process, the operator aligns the through hole 210 of the circuit board 200 with the guiding portion 132, and slightly presses the electrical connector 100. Since the barbs 131 abut against the through hole 210, and the pair of resilient arms 13 are forced to move inwardly, and the elastic deformations occurring when the resilient arms elastically deform are within the space 14. Thereafter, the operator presses the electrical connector 100 to push the barb 131 downwardly until the pair of barbs slide through the through holes 210 and lock on the bottom of the circuit 200, thereby mounting the electrical connector 100 on the circuit board 200. Since the space 14 accommodates the deformation occurring when the resilient arms 13 elastically deform, the resilient arms 13 are free from permanent deformation caused by excessive force being applied thereto. Thus, the resilient arms 13 can obtain better elasticity, and the locking device 10 can firmly mount the electrical connecotor on the circuit board 200. Additionally, since the points of initial deformation 16 are located outside of the points of engagement 1310, when the resilient arms 13 abut against an inner wall of the through hole 210, the resilient arms 13 tend to move outwardly, allowing the locking device to be more firmly mounted on the circuit board 200.

The list below shows some data collected from an experiment subjecting a conventional locking device and the locking device according to the present invention with respect to the forces exerted on circuit boards from both locking devices, respectively.

| Prior Art | Present Invention |
|---|---|
| 5.74 Kg | 6.68 Kg |
| 5.56 Kg | 6.32 Kg |
| 5.34 Kg | 5.99 Kg |
| 5.64 Kg | 6.03 Kg |

In view of the above, obviously, the locking device according to the present invention presents larger retaining forces than the conventional one does.

Figure 8:
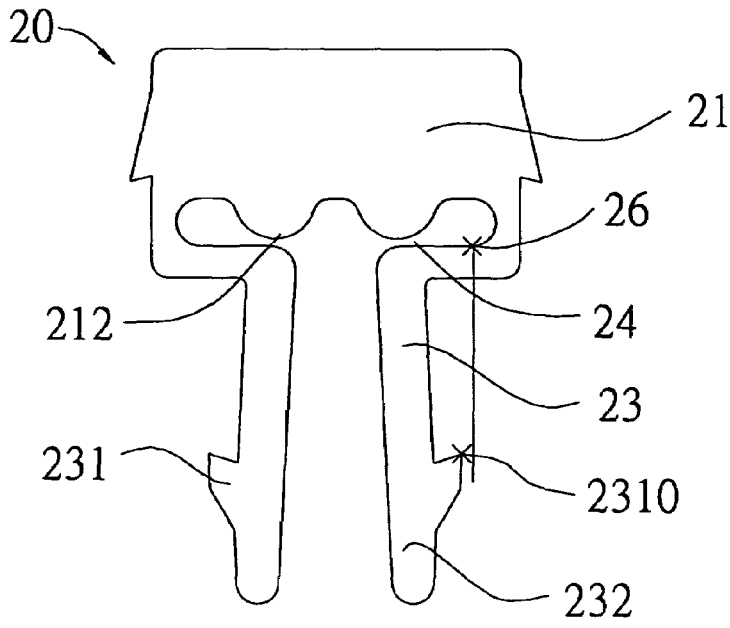
FIG. 8 is a front view showing a locking device according to a second embodiment of the present invention.
Figure 9:
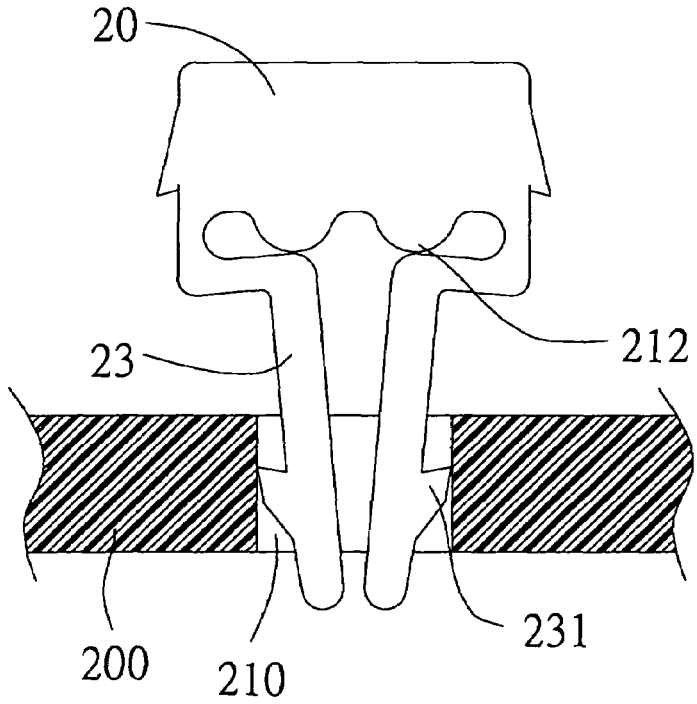
FIG. 9 is a front view showing the locking device shown in FIG. 8 being inserted into a circuit board.
Figure 10:
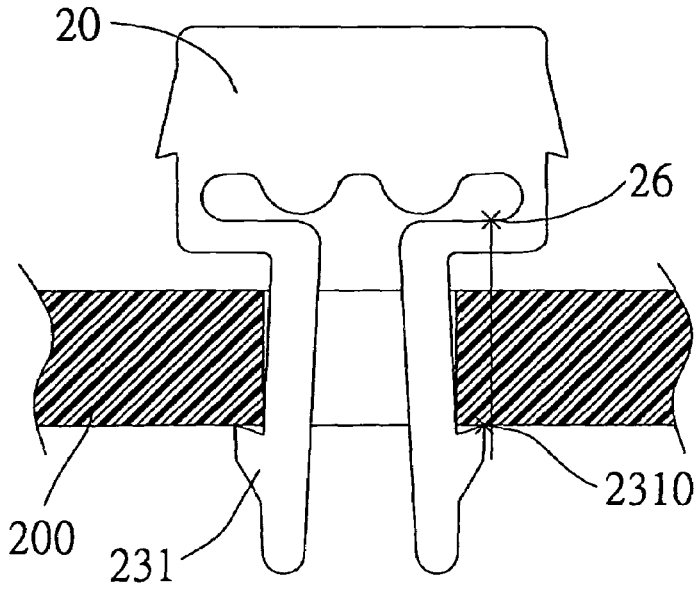
FIG. 10 is another front view showing the locking device shown in FIG. 8 mounted on a circuit board.

FIGS. 8 to 10 show another aspect of a locking device according to a second embodiment of the present invention, which is different from the previous one. In this embodiment, the body 21 is provided with a pair of protruding portions 212 each abutting against the corresponding resilient arm 23 to prevent the resilient arms 23 from excessively moving inwardly. And the pair of protruding portions 212 are accommodated in the space 24. During the assembly process, the operator aligns the through hole 210 of the circuit board 200 with the guiding portion 232, and slightly presses the electrical connector 100, thereby forcing the pair of resilient arms 23 to move inwardly. The pair of resilient arms 23 will abut against the protruding portion 212 when they are excessively moved inwardly to prevent excessive inward movement thereof. Thereafter, the operator presses the electrical connector 100 to push the hook portion 231 downwardly until the pair of hook portions 231 slide through the through holes 210 and lock on the bottom of the circuit 200. The space 24 accommodates the deformation of the resilient arms 23 occurring when the resilient arms 23 elastically deform, and, as the body 21 is provided with protruding portions 212, the resilient arms 23 can be free from permanent deformation caused by any excessive force applied thereto. Thus, the resilient arms 23 obtain better elasticity, and the points of initial deformation 26 are located outside of the points of engagement 2310. The object reached by the first embodiment can also be reached by this embodiment.

Figure 11:
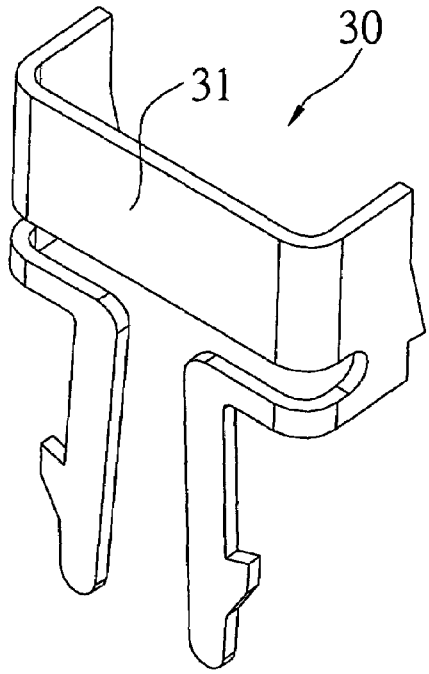
FIG. 11 is a perspective view showing a locking device according to a third embodiment of the present invention.

FIG. 11 shows a locking device 30 according to a third embodiment of the present invention. The difference between this embodiment and the first one resides in U-shaped transversal cross-section of the body 31. Unlike the plate-like body shown in the first embodiment. Both embodiments are substantially the same when reduced to practice, and therefore some details are omitted.

Although the present invention has been described with reference to the foregoing preferred embodiment, it will be understood that the invention is not limited to the details thereof. Various equivalent variations and modifications may still occur to those skilled in this art in view of the teachings of the present invention. Thus, all such variations and equivalent modifications are also embraced within the scope of the invention as defined in the appended claims.

What is claimed is:

1. A locking device adapted to mount an electrical connector on an electronic component, the locking device comprising:

a body;

connecting portions respectively extending from both sides of the body; and resilient arms downwardly extending from ends of the connecting portions;

wherein a space for accommodating the elastic deformation of the resilient arms is formed between the body and the connecting portions, said body having protruding portions each abutting against the corresponding resilient arm for preventing the resilient arms from excessively displacing inwardly.

2. The locking device as claimed in claim 1, wherein the body is shaped like a plate.

3. The locking device as claimed in claim 1, wherein the protruding portions extend from the body and are accommodated in the space.

4. The locking device as claimed in claim 1, wherein the body has a U-shaped cross section.

5. The locking device as claimed in claim 1, wherein the body is provided with at least one engaging portion for engaging with the electrical connector extending therefrom.

6. The locking device as claimed in claim 1, wherein the electronic component is substantially a circuit board.

7. The locking device as claimed in claim 1, wherein the resilient arms are each provided with a hook portion for engaging with the electronic component.

8. The locking device as claimed in claim 7, wherein the resilient arms are each provided with a guiding portion for guiding the hook portion to be engaged with the electronic component at end thereof.

9. A locking device adapted to mount an electrical connector on an electronic component, the locking device comprising:

a body;

connecting portions respectively extending from both sides of the body; and resilient arms extending from ends of the connecting portions;

wherein the locking device is provided with points of initial deformation and points of engagement, and the points of initial deformation are located outside of the points of engagement, said body having protruding portions each abutting against the corresponding resilient arm for preventing the resilient arms from excessively displacing inwardly.

10. The locking device as claimed in claim 9, wherein the points of initial deformation are located at an interconnection between the resilient arms and the connection portions.

11. The locking device as claimed in claim 9, wherein the resilient arms are each provided with a hook portion for engaging with the electronic component, and the points of engagement are each provided on the corresponding hook portion.

* * * * *